United States Patent [19]

Klose

[11] 4,067,183

[45] Jan. 10, 1978

[54] THREAD GUIDE FOR THE PRODUCTION OF CORD TWISTS

[75] Inventor: Walter Klose, Kempten, Germany

[73] Assignee: Saurer-Allma GmbH, Allgauer Maschinenbau, Kempten, Germany

[21] Appl. No.: 726,914

[22] Filed: Sept. 27, 1976

[30] Foreign Application Priority Data

Oct. 6, 1976 Germany ..... 7531677[U]

[51] Int. Cl.[2] ..... D01H 13/04

[52] U.S. Cl. ..... 57/106; 242/157 R

[58] Field of Search ..... 57/106, 108; 242/157 R

[56] References Cited

U.S. PATENT DOCUMENTS

| | | | |
|---|---|---|---|
| 2,795,925 | 6/1957 | Parker et al. | 57/106 |
| 2,882,675 | 4/1959 | Tingas | 57/108 X |
| 2,981,047 | 4/1961 | Jansen | 57/106 X |
| 3,382,657 | 5/1968 | Howath | 57/106 X |
| 3,704,578 | 12/1972 | Myers | 57/106 X |

*Primary Examiner*—Richard C. Queisser

*Assistant Examiner*—Charles Gorenstein

*Attorney, Agent, or Firm*—Blanchard, Flynn, Thiel, Boutell & Tanis

[57] ABSTRACT

A thread guide construction for use in the production of twisted threads. The thread guide is composed of a plate arranged essentially horizontally and having at least three guide eyes arranged symmetrically to one another for a separate guiding of the threads which are to be twisted. A separating member is secured to the underside of the plate between and symmetrical to the guide eyes. The separating member has a width which is less than the spacing between the guide eyes and has a surface thereon converging from the plate toward a terminal location spaced from the plate. The surface is opposed to each of the guide eyes so that when a pulling force is applied to the twisted threads during a twisting operation pulling same away from the plate, the threads are normally free of engagement with the separating member and are in engagement with the surface during a time when the pulling force has been substantially reduced.

4 Claims, 5 Drawing Figures

THREAD GUIDE FOR THE PRODUCTION OF CORD TWISTS

FIELD OF THE INVENTION

The invention relates to a thread guide for the production of cord twists, using a Mouline thread guide consisting of a substantially horizontally arranged plate and having two or more guide eyes arranged symmetrically relative to one another for the separate guiding of the threads to be twisted, which run together at an acute angle beneath the plate at a uniting point.

BACKGROUND OF THE INVENTION

For the production of cord twists, which generally consist of three threads, these three threads are guided through the delivery mechanism separately from one another and parallel to one another. Following the delivery mechanism the three threads run together at an acute angle at a uniting point and form a "thread cross." From the uniting point onwards begins the actual twisting of the three threads. Upon stopping of the frame an undesired effect occurs. Owing to the reducing thread tension in the twisting path the balance of the thread tensions is disturbed and the uniting point of the threads moves against the direction of movement of the threads towards the delivery mechanism. This motion of the uniting point is caused by the torsion stored in the threads. Upon motion of the thread cross the threads are partially unwound from one another and partially overwound, which imparts a corkscrew-like appearance to the twist. This corkscrew effect is undesirable since it spoils the appearance of the twist and moreover reduces the resistance of the twist to tearing, since the individual threads are not uniformly loaded when the twist is pulled.

In order to avoid the corkscrew effect as far as possible, hitherto only two threads have been guided under the drop stirrup of a thread breakage stopping device and the third thread was guided over the stirrup. In this way the motion of the thread cross could be stopped at the drop stirrup. In spite of this, however, the corkscrew effect occurred since the relationship to one another of the forces in the thread cross was unbalanced owing to the different modes of guiding the threads.

Mouline thread guides (so-called) are also known which are used in the production of multi-coloured twists, so-called Moulines. A known Mouline thread guide consists essentially of a horizontally arranged plate having two or more guide eyes arranged symmetrically to one another for the separate guiding of the threads to be twisted, which run together under the plate at an acute angle at a uniting point. Mixing of the various colours has to be avoided, i.e. the threads must always follow the same sequence in the finished twist. Also the use of such a Mouline thread guide in the production of cord twists is not a satisfactory solution. If upon stopping of the frame the thread tension falls, the uniting point of the three threads moves towards the underside of the plate of the Mouline thread guide. Here the threads then wind over one another and a knot-like form results by which likewise the resistance of the twist to tearing is reduced.

The invention is based on the problem of providing a thread guide for the production of cord twist, using the Mouline thread guide described, which prevents the formation of the corkscrew effect or the formation of knots and thereby permits the production of a cord twist which has the same quality and resistance over its whole length.

This is achieved in accordance with the invention by arranging on the underside of the plate between the guide eyes and symmetrically thereto a separating member the surface or surfaces of which converges or converge towards the uniting point and during the twisting process are spaced from the threads that are running together.

Surprisingly, it has been found that by means of such a separating member the corkscrew effect and the formation of knots can be avoided. Normally the individual threads run at a distance from the separating member, so that the separating member in no way adversely affects the running of the threads, does not rub the threads and itself undergoes no wear. Upon a reduction of the thread tension the uniting point runs upwardly oppositely to the direction of movement of the threads until it abuts the separating member. Since the separating member is arranged symmetrically or centrally relative to the guide eyes, upon motion of the thread cross there arise at the separating member the same conditions as regards the tensions and torsions in the individual threads and hence unwinding of the threads cannot take place.

Preferably the separating member projects from the underside of the plate so far downwardly that the threads that run on to the separating member upon reduction of tension are at an angle of at least about 45° to the underside of the plate. If this angle is 45° or more the formation of the knot or corkscrew effect is prevented with certainty.

The separating member is advantageously a ball or a half ball. If a ball is used, only the lower half-ball is effective as the new thread guide. The use of a ball has the advantage over a half ball only that balls are obtainable as commercial articles.

BRIEF DESCRIPTION OF THE DRAWINGS

The invention is explained in more detail below with reference to practical examples illustrated in the drawing.

DETAILED DESCRIPTION

Figure 1:
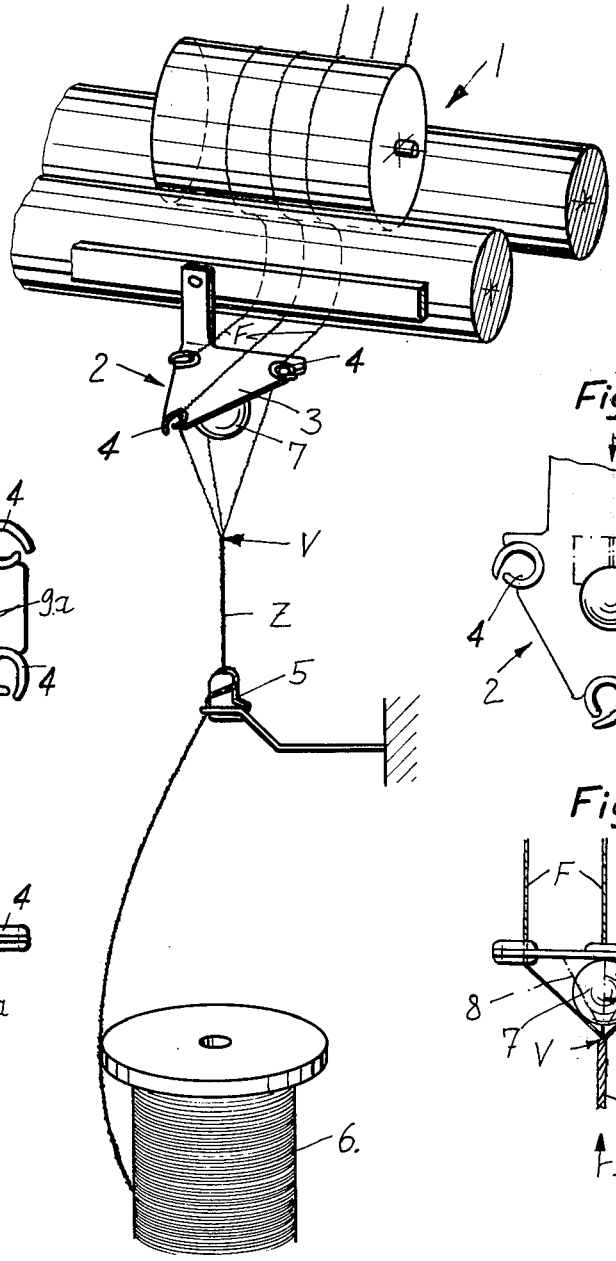
FIG. 1 is a diagrammatic illustration of the course of the threads in the manufacture of cord twist, using the novel thread guide.

In the drawing, the delivery mechanism of a cord twist frame is indicated at 1, from which mechanism in the example illustrated three individual threads F pass to the thread guide 2. The thread guide itself consists of an essentially horizontally arranged plate 3 having three guide eyes 4 which are arranged symmetrically to one another. Through each of these three guide eyes 4 one of the individual threads is guided. The three threads run beneath the plate 3 at an acute angle to a uniting point V, from which point onwards the actual twisting operation begins. Beneath the uniting point a balloon thread guide 5 is provided, from which the threads run to the bobbin 6 through a ring traveller (not shown). Owing to the thread tension, during the twisting operation the thread cross formed by the three threads beneath the plate up to the uniting point V is held in balance. Upon stopping of the frame however the thread tension reduces and the uniting point V moves upwardly against the direction of movement of the threads.

In order to limit this motion of the uniting point V and thereby prevent knot formation, there is arranged on the underside of the plate between the guide eyes 4 and symmetrical to it a separating member the surface of which converges towards the uniting point and during the twisting operation is spaced from the threads that are running together. In the example illustrated in FIGS. 1 to 3 this separating member consists of a ball 7, of which however only the lower half is effective. If the thread tension falls, the uniting point V runs upwardly until the individual threads are against the lower half ball. The ball 7 has the effect that the angle $\alpha$ that each of the three threads makes with the axis A of the twist Z does not exceed a predetermined value. At the same time the ball 7, by its symmetrical arrangement, also prevents displacement of the uniting point towards one of the three guide eyes 4. In all, the ball 7 has the effect that the threads are always twisted together in the same sequence even with reduced thread tension down to standstill of the frame, and they do not become wound over one another. The twist therefore has the same quality and resistance to pull over its whole length.

Preferably the separating member or the ball 7 projects so far downwardly that the threads that run on the ball upon a fall in tension make an angle of at least about 45° with the underside of the plate.

Figure 3:
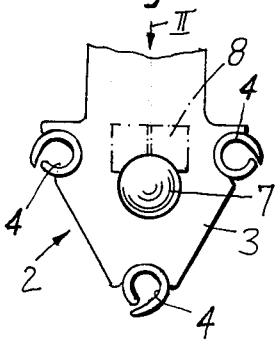
FIG. 3 is an underplan view of the thread guide looking in the direction III of FIG. 2.
Figure 2:
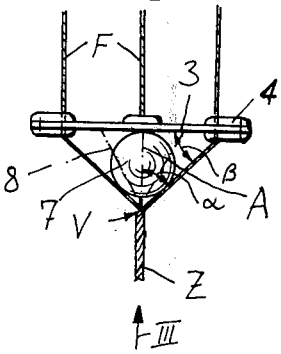
FIG. 2 is a side view of a first example of the thread guide, looking in the direction II of FIG. 3.

The thread guide illustrated in FIGS. 1 to 3 as having a ball 7 is suitable for the production of a cord twist that consists of three individual threads. If only two individual threads are to be twisted together, then the separating member is formed as a wedge 8, as shown in FIGS. 2 and 3 by dot-dash lines. The apex of this wedge extends perpendicular to the line connecting the two guide eyes, between which the wedge is arranged.

Figure 5:
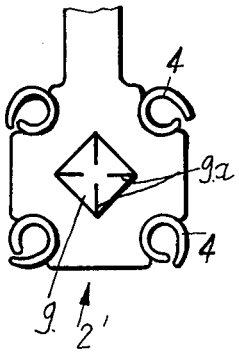
FIG. 5 is an underplan view thereof looking in the direction V of FIG. 4.
Figure 4:
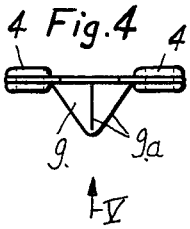
FIG. 4 is a side view of a second example.

In FIGS. 4 and 5 is illustrated a further embodiment, in which the separating member 9 is a right regular pyramid wherein the number of lateral edges 9*a* corresponds to the number of guide eyes 4, each edge 9*a* being arranged between two adjacent guide eyes. Since the thread guide 2' has four guide eyes for four individual threads 4, the pyramid 9 also has four lateral edges 9*a*. However, instead of this pyramid 9 a ball could be used in the case of four eyes, or in some cases a cone. With the ball, however, the best results are obtained and moreover it is available commercially as a manufactured article.

The embodiment of the invention in which an inclusive property is claimed are defined as follows:

1. In a thread guide for the production of cord twists for a thread consisting of a plate arranged essentially horizontally and having at least three guide eyes arranged symmetrically to one another for the separating guiding of the threads to be twisted, the improvement comprising a separating member secured to the underside of said plate between and symmetrical to said guide eyes, said separating member being smaller in width than the spacing between said guide eyes and having surface means thereon converging from said plate towards a terminal location spaced from said plate, said surface means being opposed to each of said guide eyes whereby when a pulling force is applied to the twisted threads during a twisting operation pulling same away from said plate, said threads are normally free of engagement with said surface means on said separating member and in engagement with said surface means during a time when said pulling force has been reduced.

2. The improved thread guide according to claim 1, wherein said separating member is a right regular pyramid, the number of the lateral edges corresponding to the number of guide eyes, each edge of said pyramid being arranged between two respective adjacent guide eyes.

3. The improved thread guide according to claim 1, wherein a line between said terminal location and the edge of each of said guide eyelets form an angle of about 45° with the underside of said plate.

4. The improved thread guide according to claim 3, wherein said separating member is a ball or a half ball.

* * * * *

UNITED STATES PATENT AND TRADEMARK OFFICE

CERTIFICATE OF CORRECTION

PATENT NO. : 4 067 183

DATED : January 10, 1978

INVENTOR(S) : Walter Klose

It is certified that error appears in the above-identified patent and that said Letters Patent are hereby corrected as shown below:

Change spelling of assignee "Saurer-Allma GmbH, Allgauer Maschinenbau" to ---Saurer-Allma GmbH Allgäuer Maschinenbau---.

Column 4, lines 10 and 11; change to read as follows:

---The embodiments of the invention in which an exclusive property or privilege is claimed are defined as follows:---.

Column 4, line 15; change "separating" to ---separate---.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*